US005602358A

United States Patent [19]

Yamamoto et al.

[11] Patent Number: 5,602,358

[45] Date of Patent: Feb. 11, 1997

[54] EFFECT IMPARTING DEVICE AND ELECTRONIC MUSICAL INSTRUMENT INCORPORATING SAME

[75] Inventors: Takao Yamamoto; Yoichiro Ogai; Kiyoshi Hasebe, all of Hamamatsu, Japan

[73] Assignee: Yamaha Corporation, Japan

[21] Appl. No.: 305,168

[22] Filed: Sep. 13, 1994

[30] Foreign Application Priority Data

Nov. 2, 1993 [JP] Japan ..... 5-297218

[51] Int. Cl.[6] ..... G10H 1/02; G10H 5/00

[52] U.S. Cl. ..... 84/662; 84/660; 84/697; 84/625

[58] Field of Search ..... 84/615, 618, 625, 84/626, 653, 696, 660, 662, 697

[56] References Cited

U.S. PATENT DOCUMENTS 4,628,789 12/1986 Fujimori .

*Primary Examiner*—William M. Shoop, Jr.
*Assistant Examiner*—Jeffrey W. Donels
*Attorney, Agent, or Firm*—Graham & James LLP

[57] ABSTRACT

An effect imparting device is constructed such that effects of a first kind which are different from each other are imparted to at least two of a plurality of musical tone signals transmitted via a plurality of channels. At least two of the musical tone signals are mixed. An effect of a second kind is imparted to the resulting signal. The effect imparting device is adapted to bypass at least one of effect-imparting blocks. An electronic musical instrument can change one of the effects of the first kind corresponding to a tone color of at least one of the musical tone signals transmitted via the channels simultaneously when the tone color is changed, while changing of an effect of the second kind is inhibited. A plurality of output terminals are provided through which the musical tone signals of the channels and to which effects have been imparted can be output to an external device, in a manner independent of each other.

10 Claims, 8 Drawing Sheets

SS
6
5
SOUND FIELD EFFECT-IMPARTING BLOCK
236
237
238
235
234
226
230
227
231
228
232
229
233
218
222
219
223
220
224
221
225
214
215
216
217
206
210
207
211
208
212
209
213
TONE COLOR EFFECT-IMPARTING BLOCK
202
203
204
205
201
EFFECT CONTROL BLOCK
ADDRESS DATA BUS
ch1
ch2
ch3
ch4
TG
4
2

SS
6
5
SOUND FIELD EFFECT-IMPARTING BLOCK
326
327
328
325
324
314
319
315
320
309
310
316
321
317
322
318
323
301
307
308
311
312
313
303
304
305
306
TONE COLOR EFFECT-IMPARTING BLOCK
TONE COLOR EFFECT-IMPARTING BLOCK
EFFECT CONTROL BLOCK
Line 1
302
Line 2
302'
Line 3
Line N−1
Line N
ASSI-GNER
327
ADDRESS DATA BUS
ch1
ch2
ch3
ch N−1
ch N
TG
4
2

EFFECT IMPARTING DEVICE AND ELECTRONIC MUSICAL INSTRUMENT INCORPORATING SAME

BACKGROUND OF THE INVENTION

1. Field of the Invention

This invention relates to an effect imparting device, and an electronic musical instrument incorporating the same, and more particularly to an effect imparting device for imparting effects to signals transmitted via a plurality of channels, and an electronic musical instrument incorporating the same.

2. Prior Art

Conventionally, electronic musical instruments can impart effects, such as tremolo and vibrato, to musical tones when they are generated. However, these conventional effects cannot produce sufficient variation to musical tones, and therefore, a novel effect imparting circuit (effecter) has been demanded. Recently, to meet such a demand, an effecter utilizing a DSP (Digital Signal Processor) has been developed, which is capable of imparting a variety of effects, such as chorus, flanger, distortion, and reverberation, to musical tones, each of which effects requires complicated arithmetic operations.

Now, description of a conventional electronic musical instrument will be made with reference to FIG. 2 schematically showing the arrangement of the convential electronic musical instrument. FIG. 2 includes a novel feature of the electronic musical instrument according to the invention, which will be described in detail hereinafter.

In the figure, a CPU (Central Processing Unit) 1 sequentially reads out and executes programs stored in a ROM (Read Only Memory) 9 to thereby control the operation of the electronic musical instrument. The ROM 9 stores tone color parameters, effect parameters, etc. in addition to the programs. The instrument also includes a RAM (Random Access Memory) 8 for temporarily storing variables and other data required by the CPU 1 in executing the programs.

A panel 3 is comprised of a switch group 3*a* formed of a plurality of switches, and an operating element group 3*d* formed of a plurality of operating elements. The switch group 3*a* includes two switches, labelled BP1 and BP2, 3*c* and 3*b* which have not been conventionally used but are provided according to an embodiment of the invention, described in detail hereinafter.

A keyboard 7 is comprised of a plurality of keys and a large number of switching circuits periodically scanned for various kinds of information concerning key-depressing and key-releasing operations performed by a player. When the player depresses a key or releases the same, signals indicative of information of a key code, a velocity, and an after touch on the key depressed or released are immediately generated and sent via an address/data bus 2 to the CPU 1.

The CPU 1 performs data processing according to a program, based on the signals received from the keyboard 7 to thereby determine parameters for control of a TG (Tone Generator) 4 and sends the same via the address/data bus 2 to the TG 4. The TG 4 generates a musical tone signal according to the parameters supplied by the CPU 1 and sends the same to an effecter 5. The effecter 5 imparts various kinds of effects to the musical tone signal and delivers the resulting signal to a SS (Sound System) 6. Details of the effecter 5 will be described hereinbelow. The SS 6 converts the signal, which is digital, received from the effecter 5, into an analog signal, which is then amplified by a power amplifier thereof, not shown, to a predetermined level, and finally converted into an acoustic signal, whereby a musical sound is generated.

Details of the effecter 5 will be described with reference to FIG. 1 in which blocks designated by the same reference numerals as in FIG. 2 represent means having the same functions as corresponding ones in FIG. 2. The effecter 5, which is implemented by a DSP, is divided according to functions into an assigner 12, tone color effect-imparting blocks 13, 14, sound field effect-imparting blocks 15, 16, multipliers 17 to 20, an adder 21, and an effect control block 11. The effect control block 11 controls operations of the other blocks of the effecter 5, by the use of parameters which are set or changed according to directions supplied via the address data bus 2 from the CPU 1.

The TG 4 delivers musical tone signals, more specifically, digital musical tone signals representative of musical tones having N kinds of respective tone colors different from each other, to the assigner 12, independently of, or separately from each other. The assigner 12 assigns each of the musical tone signals to either of two outputs thereof to thereby deliver two output signals therefrom. The two output signals from the assigner 12 are each divided into two branch signals whereby the branch signals are supplied to the multiplier 17, the tone color effect-imparting block 13, the multiplier 19, and the tone color effect-imparting block 14.

The tone color effect-imparting blocks 13, 14 impart effects for modifying tone colors, such as distortion, chorus, and flanger, to corresponding branch signals from the assigner 12. Selection from these effects and determination of characteristics of selected effects are performed by parameter values delivered from the effect control block 11 responsive to directions supplied via the address/data bus 2 from the CPU 1. Output signals from the tone color effect-imparting blocks 13, 14 are delivered to the sound field effect-imparting blocks 15, 16, respectively. The sound field effect-imparting blocks 15, 16 impart sound field effects, such as reverberation, in most cases, to the output signals from the preceding blocks. Modifications of reverberation characteristics are performed by changing parameter values supplied from the effect control block 11 directed via the address/data bus 2 by the CPU 1.

The output signal from the sound field effect-imparting block 15 is input to the multiplier 18. For the purpose of volume balance adjustment, the multipliers 17 and 18 multiply one of the branch signals from the assigner 12 and the output signal from the sound field effect-imparting block 15 by respective coefficients (parameter values) delivered from the effect control block 11. The resulting signals are both delivered to the adder 21. Similarly, the output signal from the sound field effect-imparting block 16 is input to the multiplier 20. For the purpose of volume balance adjustment, the multipliers 19 and 20 multiply the other of the branch signals from the assigner 12 and the output signal from the sound field effect-imparting block 16 by respective coefficients (parameter values) delivered from the effect control block 11. The resulting signals are both delivered to he adder 21.

The adder 12 adds up the four signals delivered from the multipliers 17 to 20, and delivers the resulting signal to the SS (sound system) 6, where it is converted into an analog signal, amplified to a predetermined level, and finally converted into an acoustic signal, whereby a musical sound is generated.

The effect control block 11 receives signals indicative of various kinds of control information (directions) via the address/data bus 2 from the CPU 1, and delivers control signals (parameter values) to the assigner 12, the tone color effect-imparting blocks 13, 14, the sound field effect-imparting blocks 15, 16, and the multipliers 17 to 20, according to the kinds of control information.

Now, let it be assumed as a typical example that the tone color effect-imparting block 13 and the sound field effect-imparting block 15 of the effecter 5 shown in FIG. 1 are set to impart distortion and room reverberation, respectively, and the tone color effect-imparting block 14 and the sound field effect-imparting block 16 of the same to impart chorus and room reverberation, respectively. If a signal representative of a musical tone having a tone color of guitar is delivered from a channel ch1 of the TG 4, the assigner assigns this signal, for example, to the tone color effect-imparting block 13, and another signal representative of a musical tone having a tone color of strings to the sound effect-imparting block 15.

According to these settings, the tone color effect-imparting block 13 modifies the tone color of guitar into a distortion guitar tone, while the tone color effect-imparting block 14 modifies the tone color of strings into a multichannel ensemble strings tone. Further, the sound field effect-imparting blocks 15, 16 properly impart reverberation to the resulting signals, thereby causing a desired musical tone to be generated. A degree of reverberation imparted by the sound field effect-imparting block 16 is often set to a larger value than a degree of reverberation imparted by the sound field effect-imparting block 15 (i.e. the coefficient used in the multiplier 20 is made larger than that used in the multiplier 18), thereby making the feeling of ensemble conspicuous.

In the above example, distortion and chorus are examples of tone color effects to be imparted to a musical tone to be generated. However, there are cases in which other tone color effects, such as flanger and phaser, are desired, depending on the tone colors of musical tones represented by musical tone signals delivered from the TG 4. Recently, some electronic musical instruments have tone generators each adapted to generate e.g. as many as 16 kinds of musical instrument tones and deliver them via 16 channels at the same time. Ideally, 16 different tone color effect-imparting blocks are required for respective 16 channels from the tone generator. Further, to achieve settings for imparting suitable degrees of reverberation to the respective tones, it is necessary to provide 16 sets each comprised of a tone color effect-imparting block and a sound field effect-imparting block connected in series as shown in FIG. 1, which leads to a much increased size of an electronic musical instrument.

Further, some conventional effecters and electronic musical instruments are each equipped with a bypass switch for bypassing means for imparting effects to musical tone signals. However, this bypass switch causes musical tone signals to bypass both a tone color effect-imparting block for imparting a tone color effect to modify a tone color and a sound field effect-imparting block for imparting a sound field effect to create a particular sound field. Consequently, even if only a sound field effect for generating a sound field is desired to be imparted to the musical tone signal by an external effecter, the tone color effect as well ceases to be imparted to the musical tone signal, causing musical tones to be delivered in their incomplete state.

The bypass switch is advantageous in that musical tones to which are imparted various kinds of effects can be compared by listening with a musical tone having no effects, by operating the bypass switch in a one-step manner. More specifically, this function is realized by setting the coefficients to be supplied to the multipliers 17, 19 in FIG. 1 to "1" and the coefficients to be supplied to the multipliers 18, 20 in the same to "0", in response to pushing of the bypass switch. To effect a fine adjustment of the tone color effect-imparting block, it is desirable to cause the musical tone signal to bypass the sound field effect-imparting block alone, which, however, cannot be effected by the conventional effecter, so that the fine adjustment requires laborious works, e.g. of adjusting the tone color effect-imparting block after setting the degree of reverberation to be effected by the sound field effect-imparting block to zero, and then adjusting again the reverberation to a proper degree. Further, if it is desired to impart the sound field effect alone to the musical tone, while bypassing the tone color effect-imparting block, for the purpose of adjustment of tone quality thereof before it is input to the effecter, much labor is required in adjusting operations, as well.

Furthermore, although some conventional electronic musical instruments are adapted to change effects to be imparted to a musical tone simultaneously with a change of the tone color of the musical tone to be generated, they change the whole effect-imparting program, which prevents them from individually changing tone-color modifying effects in a manner corresponding to a change in the tone color, especially in performing an automatic performance using many tone colors.

Some conventional electronic musical instruments have output terminals provided for respective signals representative of tone colors, which permits the instruments to be connected to an external effecter. However, they are not adapted to utilize effecters incorporated therein for modification of the tone color.

SUMMARY OF THE INVENTION

It is a first object of the invention to provide an effect imparting device which is capable of imparting the most suitable effects to musical tones transmitted via a plurality of channels, respectively, and is at the same time capable of reducing the size of the circuitry of the device to the minimum, and an electronic musical instrument incorporating the same.

It is a second object of the invention to provide an effect imparting device which is capable of finely varying parameters used by effect imparting means and also can be conveniently connected to an external effecter for creating large-scale sound fields, and an electronic musical instrument incorporating the same.

It is a third object of the invention to provide an electronic musical instrument which is capable of changing an effect corresponding to a tone color of a signal from at least one channel to be changed, without changing the sound field effect, when instructed to change the tone color, to thereby prevent the change of the tone color from affecting other tone colors of a musical tone being then generated or causing a feeling of unnaturalness, in changing the tone color per channel during automatic performance or a like performance operation.

It is a fourth object of the invention to provide an electronic musical instrument which is capable of sending to an external device, such as a mixer, a recording device and an effecter, musical tones of a plurality of channels, to which have been imparted respective different effects, independently of or separately from each other, and hence convenient to use or affords a wide variety of uses.

To attain the first object, the present invention provides an effect imparting device comprising first effect imparting means for imparting effects of a first kind which are different from each other, respectively, to a plurality of musical tone signals transmitted via a plurality of channels, mixing means for mixing at least two of the musical tone signals to which effects have been imparted by the first effect imparting means, and second effect imparting means for imparting at least one effect of a second kind to an output from the mixing means.

Preferably, the first effect imparting means imparts respective different tone color effects as the effects of the first kind to the musical tone signals, and the second effect imparting means imparts at least one sound field effect as the at least one second effect of the second kind to the output from the mixing means.

To attain the second object, the present invention provides an effect imparting device comprising a plurality of effect imparting means for imparting effects to musical tone signals, bypass means for bypassing at least one of the effect imparting means, bypass directing means for giving a direction for causing the bypass means to bypass the at least one effect imparting means, and bypass control means responsive to the direction from the bypass directing means, for controlling the bypass means to bypass the at least one effect imparting means.

Preferably, the effect imparting means include a plurality of first effect imparting means for imparting respective different tone color effects to the musical tone signals transmitted via a plurality of channels, and at least one second effect imparting means for imparting at least one sound field effect to the musical tone signals.

Further preferably, the bypass directing means is capable of directing the bypass means to selectively bypass at least one of the first effect imparting means or the at least one second effect imparting means.

To attain the third object, the present invention provides an electronic musical instrument comprising first effect imparting means for imparting effects of a first kind which are different from each other, respectively, to a plurality of musical tone signals transmitted via a plurality of channels, mixing means for mixing at least two of the musical tone signals to which effects have been imparted by the first effect imparting means, second effect imparting means for imparting at least one effect of a second kind to an output from the mixing means, tone color changing means for changing a tone color of at least one of the musical tone signals transmitted via at least one of the channels, effect changing means for changing at least one of the effects of the first kind corresponding to the at least one musical tone signal, in response to a change of the tone color of the at least one musical tone signal by the tone color changing means, and effect change control means for controlling the effect changing means to simultaneously change the tone color of the at least one musical tone signal and the at least one effect of the first kind corresponding to the at least one musical tone signal, while inhibiting changing the at least one effect of the second kind.

Preferably, the first effect imparting means impart respective different tone color effects as the effects of the first kind to the musical tone signals, and the second effect imparting means imparts at least one sound field effect as the at least one effect of the second kind to the output from the mixing means.

To attain the fourth object, the present invention provides an electronic musical instrument comprising effect a plurality of imparting means for imparting effects which are different from each other, respectively, to a plurality of musical tone signals transmitted via a plurality of channels, and a plurality of output terminals for outputting the musical tone signals to which the effects have been imparted by the effect imparting means, separately from each other, to an external device.

The above and other objects, features, and advantages of the invention will become more apparent from the following detailed description taken in conjunction of the accompanying drawings.

DETAILED DESCRIPTION

The invention will be described in detail with reference to the drawings.

Figure 1:
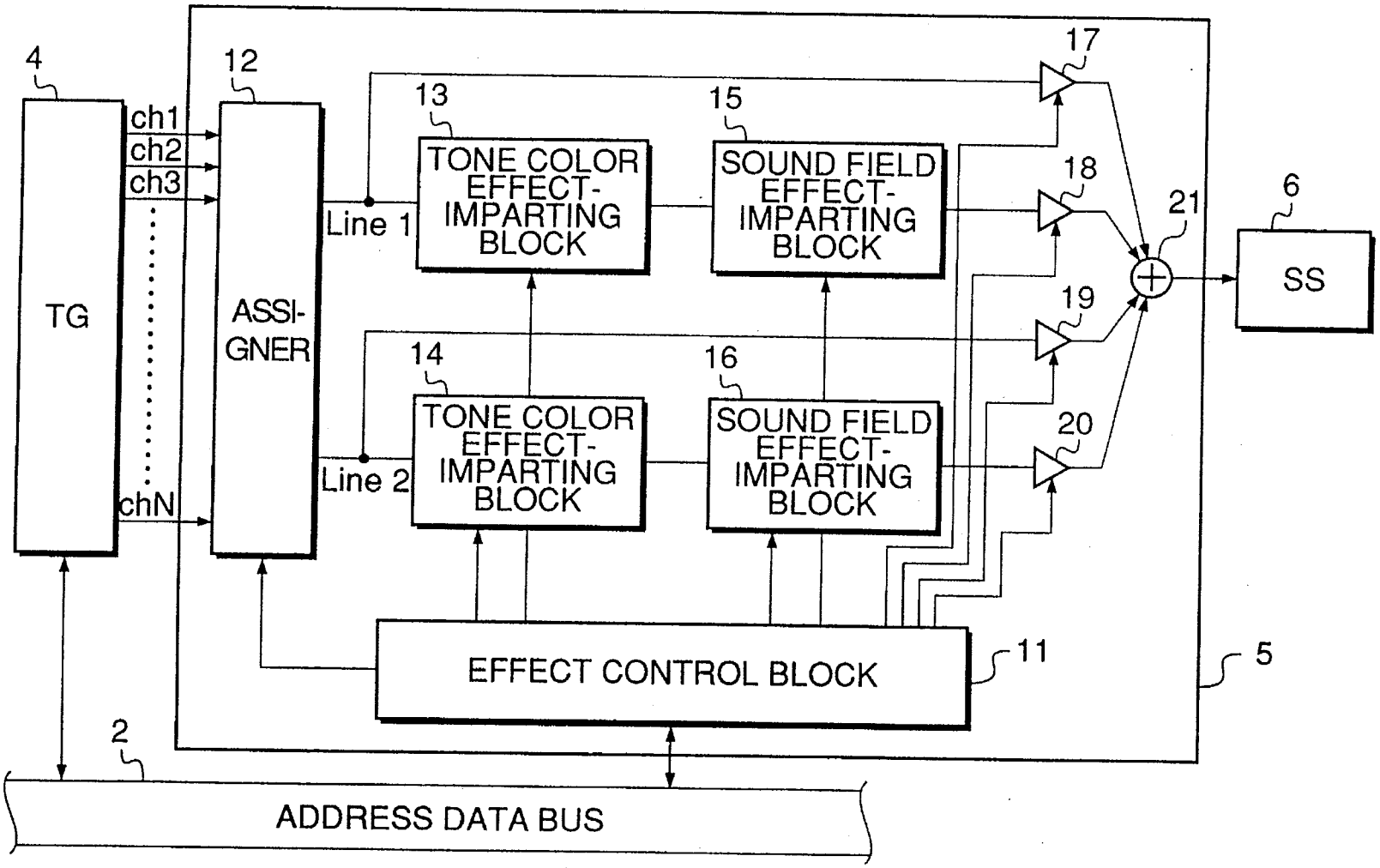
FIG.1 (PRIOR ART)
FIG. 1 is a block diagram showing the arrangement of a conventional effecter.
Figure 2:
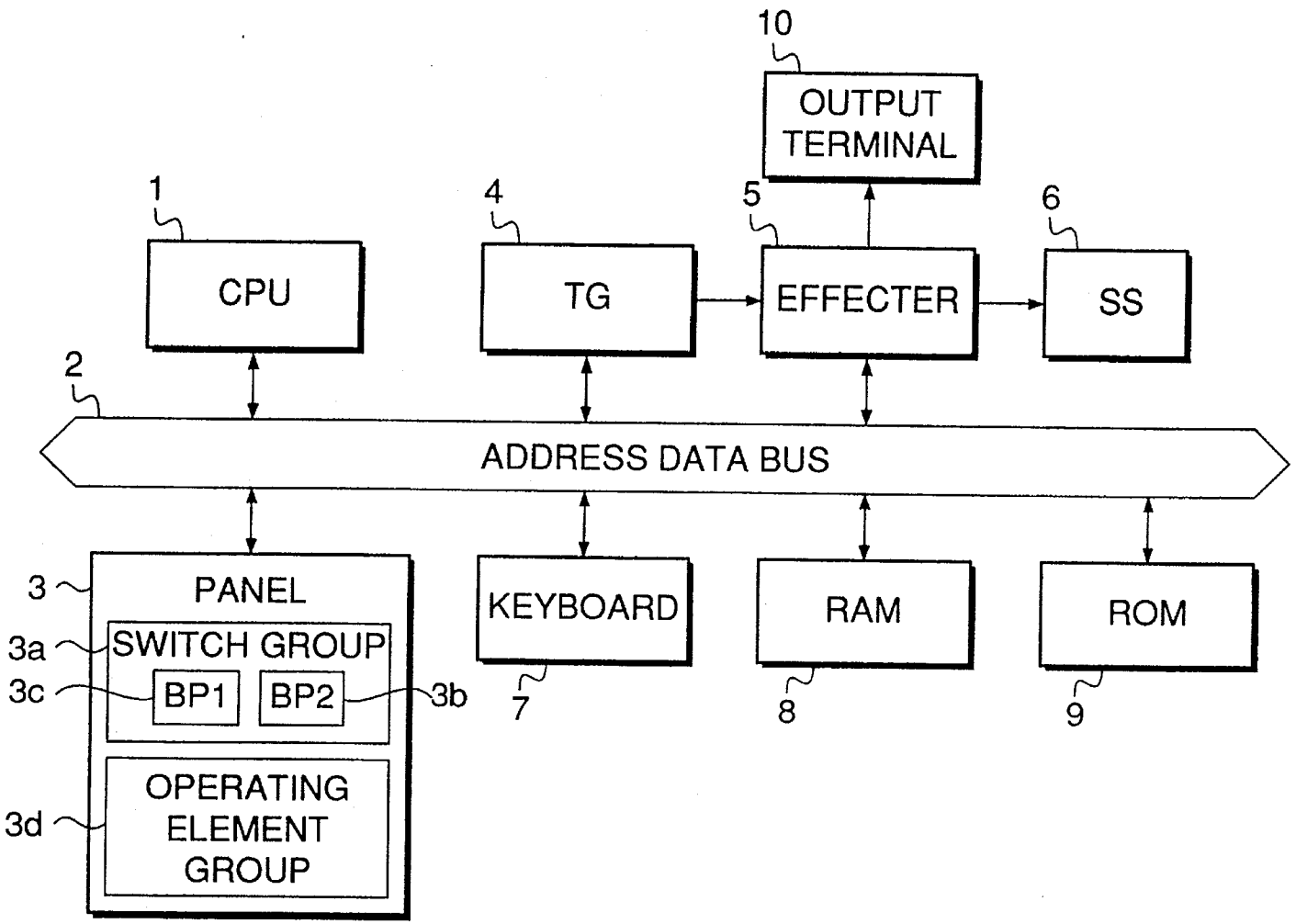
FIG. 2 is a block diagram showing the whole arrangement of an electronic musical instrument according to the invention.

FIG. 2 shows the whole arrangement of an electronic musical instrument according to the invention. Detailed description thereof is omitted since this figure is referred to hereinabove in explaining the prior art. It should be noted that the BP1 switch 3*c* and the BP2 switch of the switch group 3*a* constitute novel features of the invention. An output terminal 10 is comprised of a plurality of terminals, through which musical tone signals having tone color effects imparted thereto are permitted to be delivered independently of each other.

Figure 3:
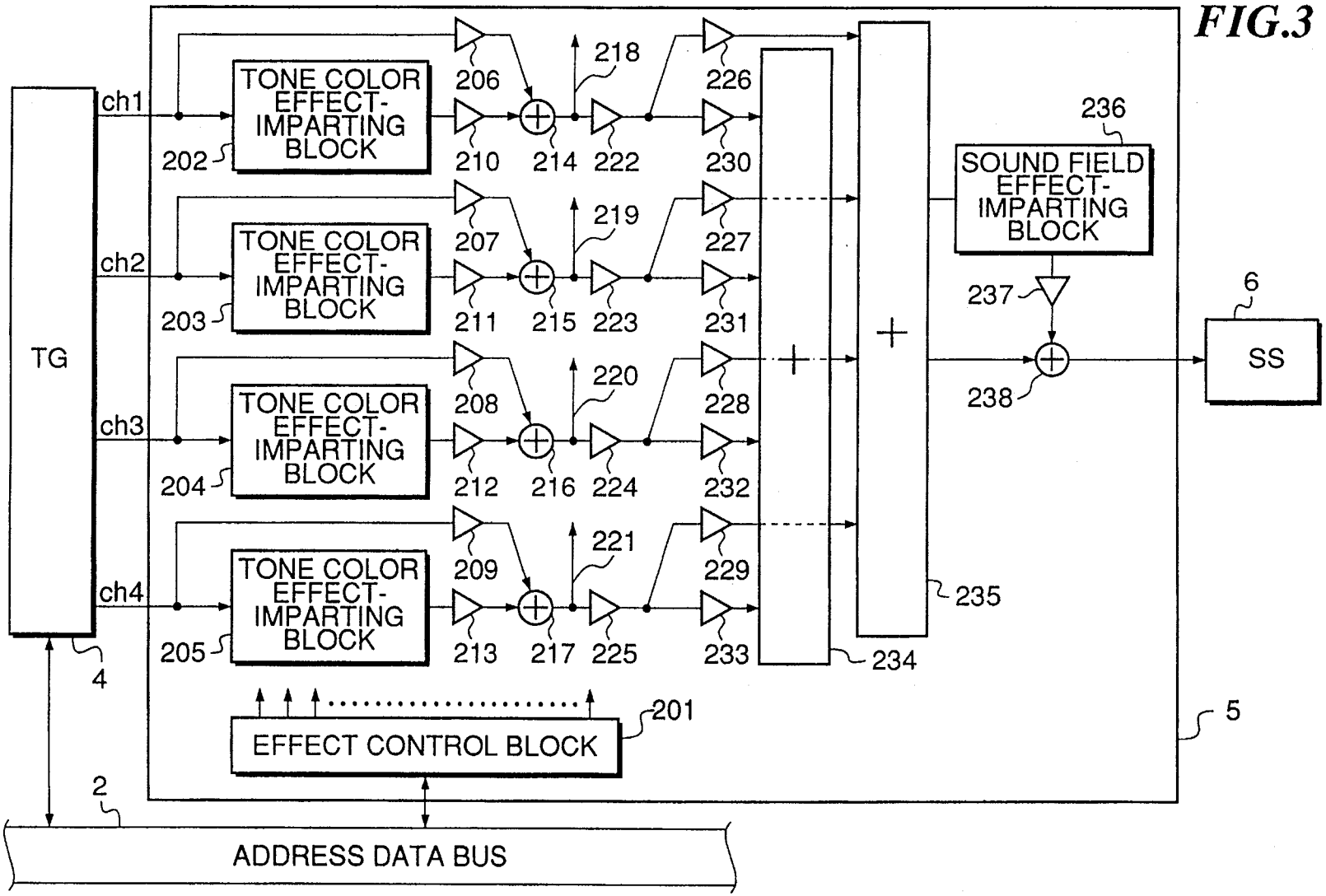
FIG. 3 is a block diagram showing the arrangement of an effecter according to a first embodiment of the invention.

FIG. 3 shows an effecter 5 according to a first embodiment of the invention. The effecter 5 is implemented by a DSP (Digital Signal Processor). Elements and parts identical in function to those in FIG. 2 are designated by identical reference numerals, and detailed description thereof is omitted.

In the figure, an effect control block 201 delivers various kinds of control signals, with connecting destinations thereof not being shown for simplicity and clarity of the illustration. In actuality, control signal lines, not shown, are provided for connection between the effect control block 201 and tone color effect-imparting blocks 202 to 205, a sound field effect-imparting block 236, and multipliers 206 to 213, 222 to 233, and 237.

This embodiment is characterized by tone color effect-imparting blocks provided in a number equal to the number of tone colors of signals generated by the TG 4. In the arrangement of FIG. 3, there are provided four tone color effect-imparting blocks, by way of example. Output channels ch1 to ch4 of the TG 4 are directly connected to the tone color effect-imparting blocks 202 to 205, respectively. This is for imparting respective suitable effects to tone colors different from channel to channel, and therefore, the tone color effect-imparting blocks 202 to 205 are capable of being set for different effects. More specifically, the tone color effect-imparting blocks 202 to 205 are set, for example, such that they impart effects, such as chorus, flanger, symphonic, pitch change, and distortion, to respective tone color signals input thereto via the output channels. The kinds of tone color effects to be imparted to musical tone signals transmitted via the respective channels by these tone color effect-imparting blocks are directed by the CPU 1 via the address/data bus 2 and the effect control block 201.

The tone color effect-imparting blocks 202 to 205 are capable of selectively imparting these effects, depending upon the tone colors of musical tone signals from the TG 4. When a musical tone signal delivered via any channels from the TG 4 is changed in respect of tone color, the tone color effect to be imparted by the corresponding tone color effect-imparting block is changed simultaneously. Let it be assumed, for example, that the output channel ch1 of the TG 4 has been set to impart the tone color of piano, and the tone color effect-imparting block 202 to impart chorus. If a player operates a tone color-selecting switch, not shown, within the switch group 3*a* of the panel 3 to select the tone color of guitar for the channel ch1, the CPU 1 gives instructions to the TG 4 to deliver a signal representative of tones of guitar via the channel ch1, and instructions to the effect control block 201 to cause the tone color effect-imparting block 202 to change the effect to be imparted thereby from chorus to distortion.

The output channels ch1 to ch4 of the TG 4 are each bifurcated into two branches before they are connected to the tone color effect-imparting blocks 202 to 205, one of each pair of branches leading to the color effect-imparting blocks 202 to 205 and the other branch to the adders 214 to 217 by way of the multipliers 206 to 209. Outputs from the tone color effect-imparting blocks 202 to 205 are input via the multipliers 210 to 213 to the adders 214 to 217 where they are added to corresponding outputs from the multipliers 206 to 209, respectively. The multipliers 206 to 213 and the adders 214 to 217 form mixers, which adjust the effect balance of the tone color effect-imparting blocks 202 to 205.

Outputs from the adders 214 to 217 are each divided into two branch signals, one of each pair of the branch signals being delivered to a corresponding one of the multipliers 222 to 225, and the other branch signal as an independent and separate output from branch signals of the other pairs via a corresponding one of lines 218 to 221 collectively represented by the output terminal 10 in FIG. 2. These branch signals, which are digital, may be delivered from the effecter 5 to the outside, or alternatively may be converted by digital-to-analog converters, and then delivered to the outside through the output terminal 10. The independent outputs are supplied to a mixer, a recording device, an effecter, or the like, outside the electronic musical instrument.

The multipliers 222 to 225 adjust the balance of volume of tone color signals, and output signals therefrom are each divided into two branch signals, one of each pair of the branch signals being input to a corresponding one of the multipliers 226 to 229, and the other branch signal to a corresponding one of the multipliers 230 to 233. The multipliers 226 to 229 determine the levels of the corresponding branch signals delivered to the sound field effect-imparting block 236, which makes it possible to adjust the degrees of sound field effects to be imparted by the sound field effect-imparting block according to respective tone colors. The outputs from the multipliers 226 to 229 are input to the adder 235, where they are added together.

An output signal from the adder 235 is delivered to the sound field effect-imparting block 236, where a suitable sound field effect is imparted to the output signal under directions from the CPU 1. The sound field effect is, more specifically, a reverberation effect, which is selected, under directions from the CPU 1, from a variety of effects according to various types of acoustic space to be simulated by the effects, such a concert hall, a reverberation room, a stadium, and a live house. An output from the sound field effect-imparting block 236 is delivered to the multiplier 237, where the level of the signal with the sound field effect imparted thereto is adjusted. An output signal from the multiplier 237 is input to the adder 238.

The multipliers 230 to 233 adjust the levels of the respective corresponding branch signals to which the sound field effect is not to be imparted. Output signals from the multipliers 230 to 233 are input to an adder 234, where they are added together. An output signal from the adder 234 is input to the adder 238, whereby it is added to the output signal from the multiplier 237. An output signal from the adder 238 is delivered to the SS 6.

Figure 8:
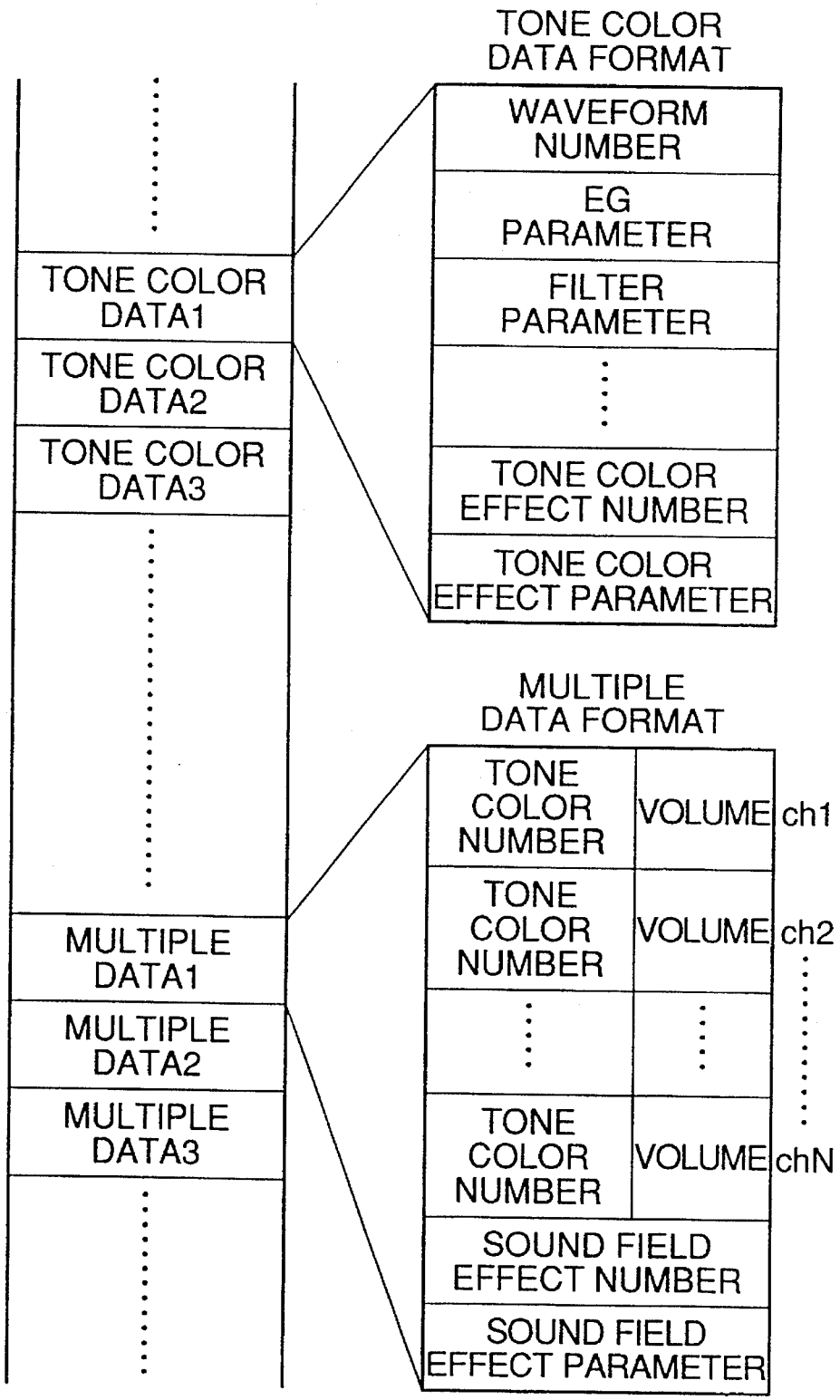
FIG. 8 is a diagram showing formats of tone color data and multiple data.

FIG. 8 shows storage formats of tone color data and multiple data stored in the RAM 8. The tone color data are stored together in one area of the RAM 8. A number of tone color data 1, 2, 3 . . . are stored in the tone color data area. Each tone color data is formed of various parameters for realizing a tone color e.g. of piano, guitar, or the like, which include a waveform number, an EG (Envelope Generator) parameter, and a filter parameter, which are to be sent to the TG 4, and a tone color effect number, and a tone color effect parameter, which are to be sent to the effecter 5.

The multiple data 1, 2, 3 are each used to change all the tone colors of musical tone signals delivered from the output channels of the TG 4, and each contain tone color numbers assigned to respective channels, and data of volumes of tones having the respective tone colors. Further, the multiple data each contain a sound field effect number, and a sound field effect parameter for changing the sound field effect. A change of multiple data is effected when a piece of music for performance is changed during automatic performance of the electronic-musical instrument.

When a change of multiple data is instructed by the player, the CPU 1 reads multiple data from the RAM 8 according to the number of multiple data to which the present multiple data is changed, thereby obtaining tone color numbers and volume data for respective channels ch1 to chN. The CPU 1 reads tone color data from the RAM 8 according to the tone color numbers, and thereby sends the tone color data as well as the volume data to the TG 4. Since each tone color data contains a tone color effect number and a parameter of the tone color effect, the CPU sends the tone color effect number and the corresponding parameter of the tone color effect, thus read out, to a tone color effect-imparting block connected to a corresponding channel to be changed in respect of tone color, thereby changing the tone color effect. The same operations are carried out for the rest of the channels.

Then, the sound field effect number and the sound field effect parameter contained at the tail of the multiple data item are read out from the RAM 8 and sent to the sound field effect-imparting block 236. Thus, changes of the tone colors are effected for all the channels of the TG 4 and changes of effects to be imparted by all the tone color effect-imparting blocks and the sound field effect-imparting block.

Figure 4:
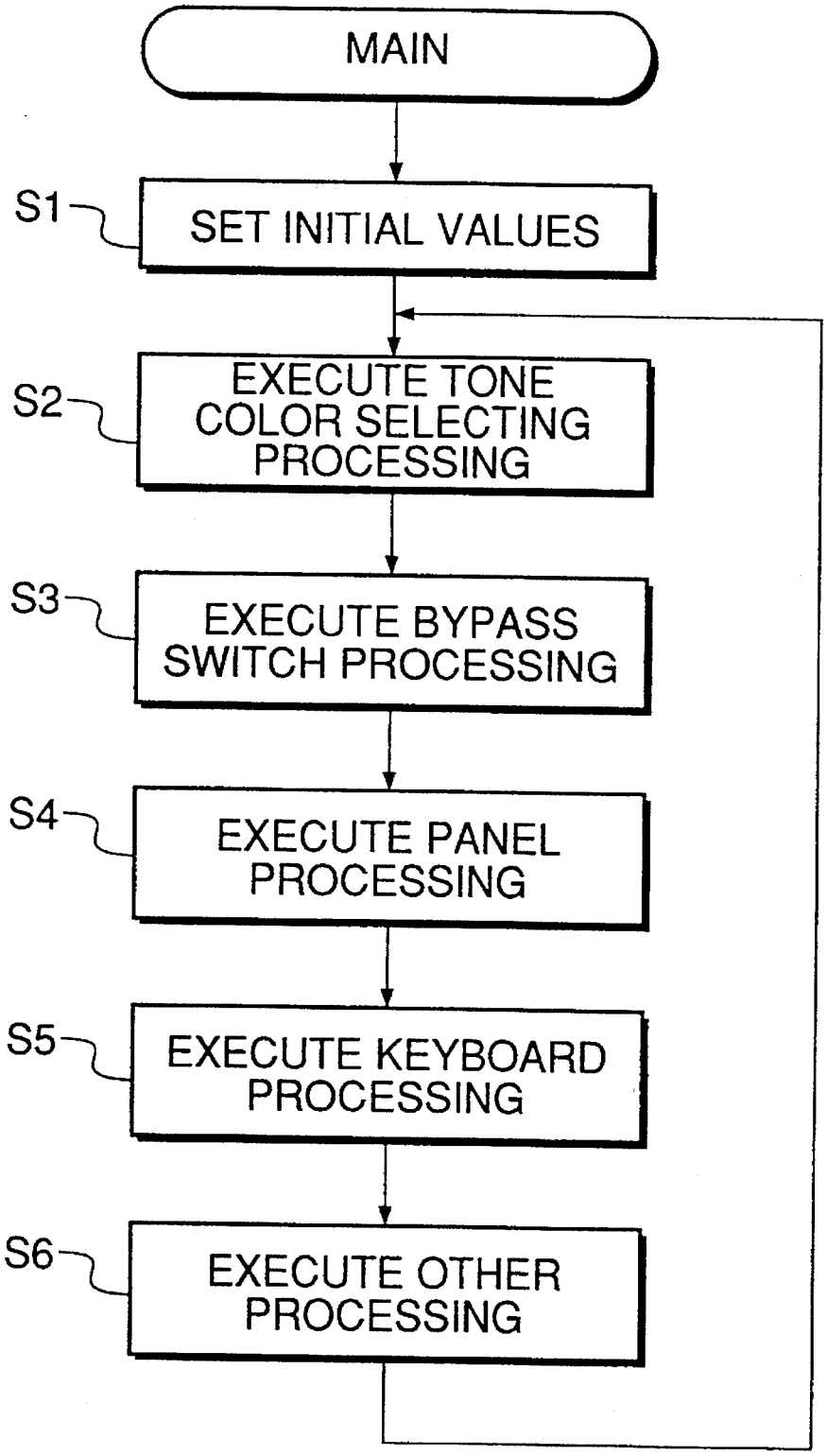
FIG. 4 is a flowchart of a program (main routine) for control of operations of the electronic musical instrument according to the invention.
Figure 5:
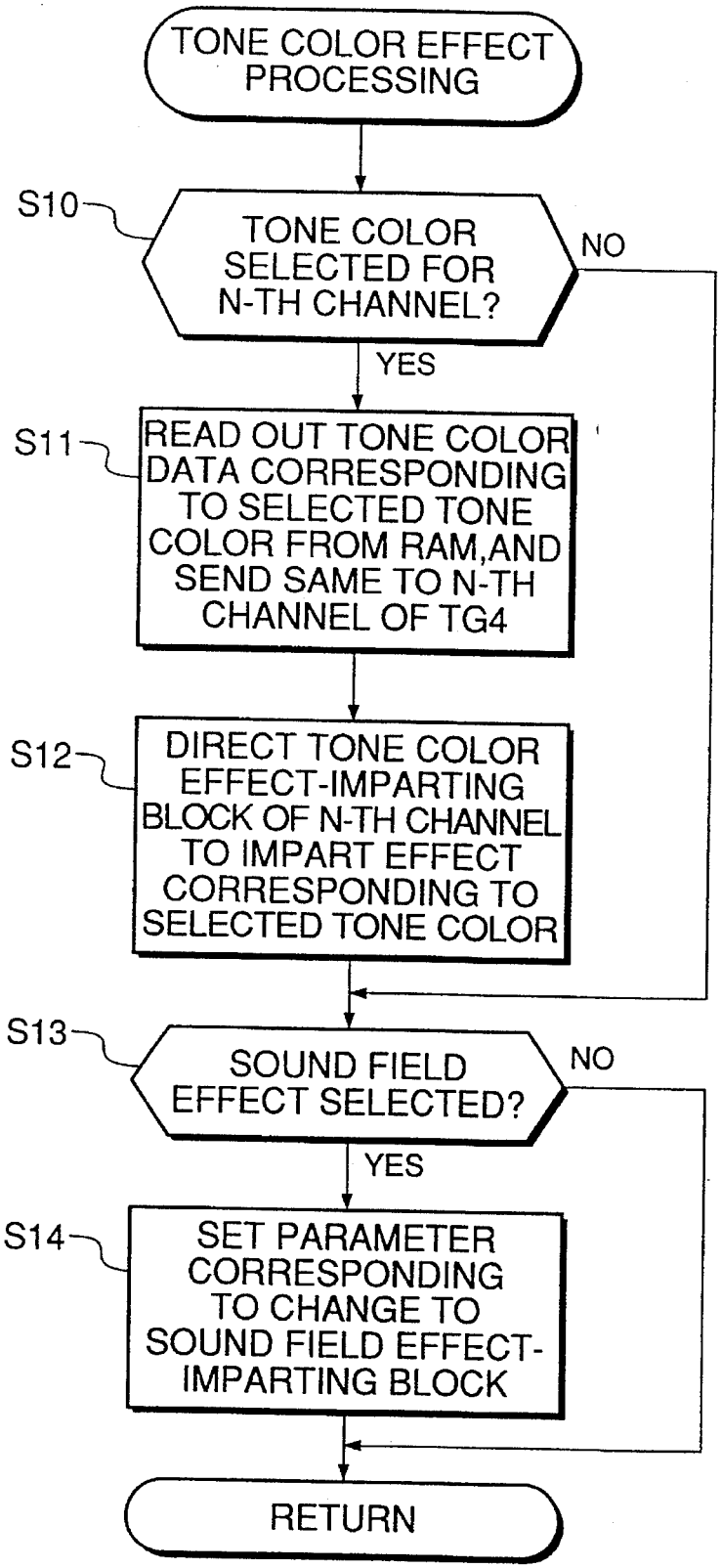
FIG. 5 is a flowchart of a program (subroutine) of tone color-selecting processing executed by the program of FIG. 4.
Figure 6:
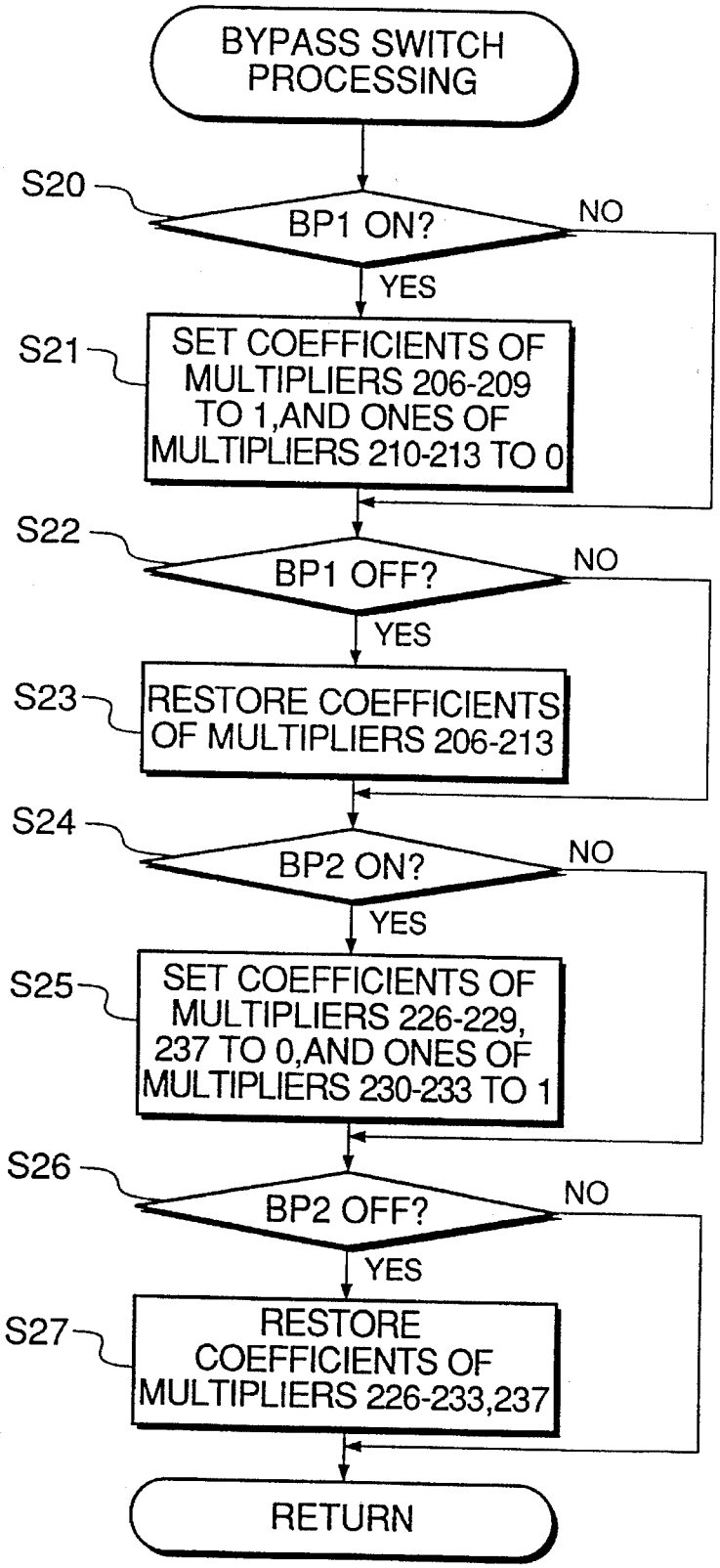
FIG. 6 is a flowchart of a program (subroutine) of bypass switching processing executed by the program of FIG. 4.

Next, the operation of the electronic musical instrument according to the first embodiment of the invention will be described with reference to FIG. 4 to FIG. 6. FIG. 4 shows a main routine of the operation performed by the electronic musical instrument. First, when the power is applied to the electronic musical instrument, initializations, such as clearing of the registers, are carried out at a step S1. Then, tone color selecting processing is executed at a step S2. Details of the tone color-selecting processing will be described hereinafter with reference to FIG. 5. Then, bypass switching processing is executed at a step S3. Details of the bypass switching processing at the step S3 will be described hereinafter with reference to FIG. 6.

Then, the program proceeds to a step S4, where panel processing is performed. This step executes tone color setting processing, processing related to the bypass switch, and processing to be executed when any switch of the switch group 3*a* or any operating element of the operating element group 3*d* on the panel 3 is operated.

At a step S5, keyboard processing is executed. When the CPU 1 executes the keyboard processing, data processing is executed according to performance information generated when the player operates the keyboard 7 for performance, thereby directing the TG 4 to perform generation or attenuation of tone signals.

At a step S6, programs other than the above-mentioned ones are executed which are required for operations of the electronic musical instrument. For example, processing related to inputting and outputting of MIDI (Musical Instrument Digital Interface) and processing related to an external memory (a floppy disk or a memory card), none of which are shown, are executed. Then, the program returns to the step S2, and thereafter the steps S2 to S6 are repeatedly carried out. The processing operations from the step S2 through S6 are performed at a high speed, and so long as operation of performance or setting of the instrument by the player or communication with an external device is not executed, no particular processing operation is performed, but when any event has occurred, processing operations corresponding thereto are executed.

Now, the tone color-selecting processing will be described with reference to FIG. 5. At a step S10, it is determined whether or not a tone color-selecting operation has been effected for an N-th channel. This step is related to an operation of a switch provided on the panel 3 as a member of the switch group 3*a* for selecting a tone color. In this connection, the panel 3 is provided with switches including the above, not shown, as members of the switch group 3*a*, for permitting selection of a tone color for each channel through operation thereof. If the answer to the question of the step S10 is affirmative (yes), i.e. the tone color-selecting operation for the N-th channel has been effected, the program proceeds to a step S11, whereas if the answer is negative (no), the program jumps to a step S13.

At the step S11, tone color data corresponding to the tone color selected is read out from the RAM 8 and sent to the N-th channel of the TG 4. Then, the CPU1 directs the tone color effect-imparting block of the N-th channel to impart an effect corresponding to the selected tone color, at a step S12, followed by the program proceeding to the step S13.

At the step S13, it is determined whether or not an operation of setting a sound field effect has been effected. The setting of a sound field effect includes changing a sound field effect, and fine adjustment of a parameter of a sound field effect. If the answer to this question is affirmative (yes), a parameter corresponding to any change of the setting is set to the sound field effect-imparting block 236 at a step S14. Then, the program returns to the FIG. 4 main routine. If it is determined at a step S13 that no setting operation has been effected, the program also returns to the main routine.

Now, the bypass switching processing will be described in detail with reference to FIG. 6.

First, it is determined at a step S20 whether or not the bypass switch (BP1: 3*c*) has been turned on. If the answer to this question is affirmative (yes), the program proceeds to a step S21, where the coefficients used in the multipliers 206 to 209 are set to 1, and those used in the multipliers 210 to 213 to 0. This causes the adders 214 to 217 to deliver only signals formed by branch signals bypassing the tone color effect-imparting blocks 202 to 205. Then, the program proceeds to a step S22. If the answer to the question of the step S20 is negative (no), the program skips over the step 21 to the step S22.

At the step S22, it is determined whether or not the bypass switch 1 (BP1: 3*c*) has been turned off. If the answer to this question is affirmative (yes), the program proceeds to a step S23, where the coefficients used in the multipliers 206 to 213 are restored to preceding values, i.e. those values used before the bypass switch 1 has been turned on. Then, the program proceeds to a step S24. If the answer to the question of the step S22 is negative (no), the program skips over the step S22 to the step S24.

At the step S24, it is determined whether or not the bypass switch (BP2: 3*d*) has been turned on. If the answer to this question is affirmative (yes), the program proceeds to a step S25, where the coefficients used in the multipliers 226 to 229, and 237 are set to 0, and those used in the multipliers 230 to 233 to 1. This causes the adder 238 to deliver only a signal formed only by an output signal from the adder 234 which has bypassed the sound field effect-imparting blocks 236. Then, the program proceeds to a step S26. If the answer to the question of the step S24 is negative (no), the program skips over the step 24 to the step S26.

At the step S26, it is determined whether or not the bypass switch 2 (BP2: 3*d*) has been turned off. If the answer to this question is affirmative (yes), the program proceeds to a step S27, where the coefficients used in the multipliers 226 to 233 and 237 are restored to preceding values, i.e. those values used before the bypass switch 2 has been turned on. Then, the program returns to the FIG. 4 main routine. If the answer to the question of the step S26 is negative (no), the program skips over the step S26 to return to the FIG. 4 main routine.

Figure 7:
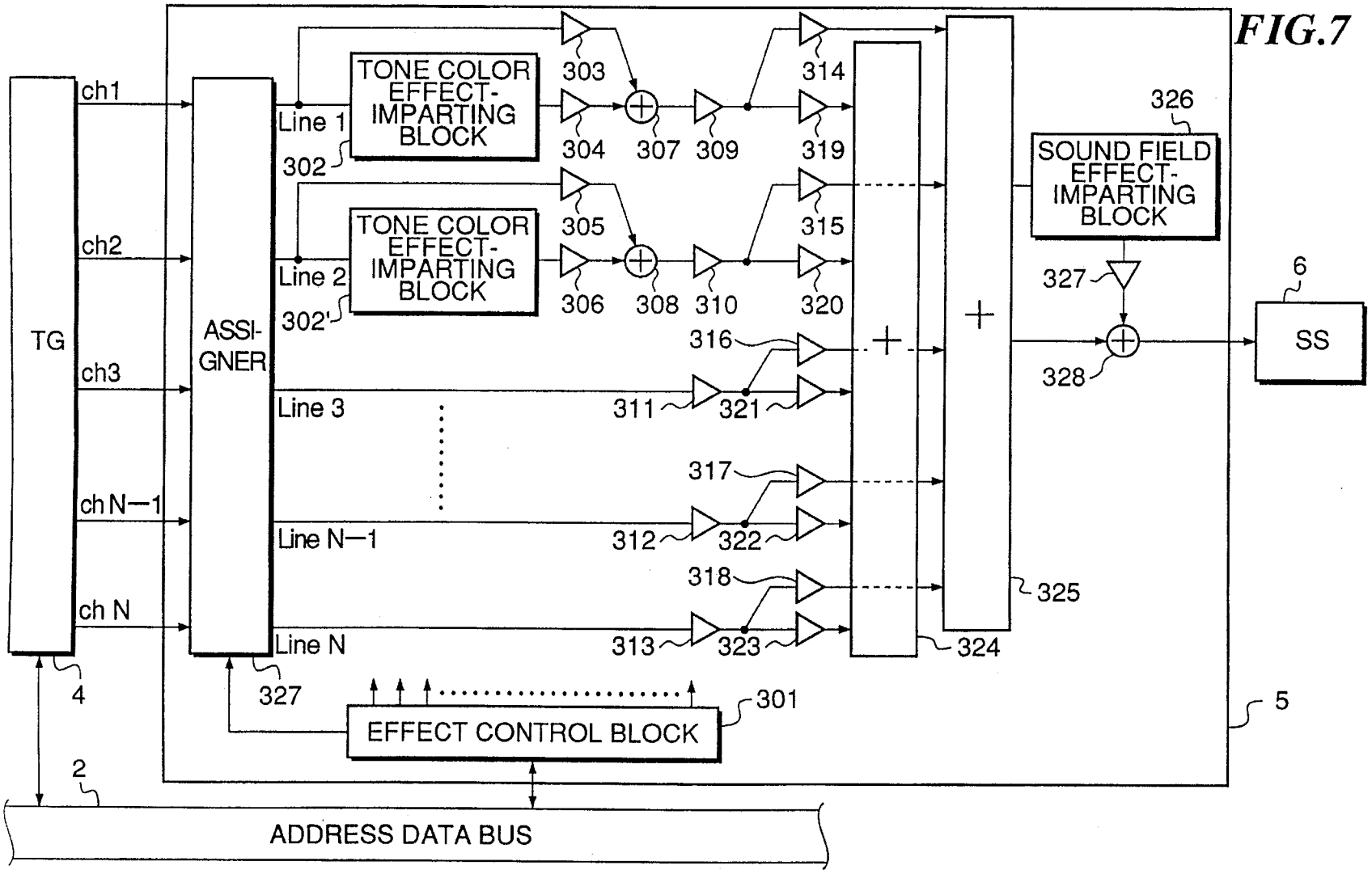
FIG. 7 is a block diagram showing the arrangement of an effecter according to a second embodiment of the invention.

FIG. 7 shows a second embodiment of the invention, which is distinguished from the first embodiment shown in FIG. 3 in that the TG 4 generates musical tone signals of N channels, and the number of tone color effect-imparting blocks is smaller than N. That is, the number of output channels of the TG 4 is not equal to the number of the tone color effect-imparting blocks provided, and therefore, an assigner 327 is provided for assigning the output channels ch1 to chN of the TG 4 to lines Line 1 to Line N, as desired. Information for this assigning operation is supplied via the effect control block 301 and the address/data bus 2 from the CPU 1. The rest of the circuit configuration is identical to that of the FIG. 3 circuit, and hence description thereof is omitted.

Lines Line 3 to Line N, as outputs from the assigner 3, are not connected to any tone color effect-imparting blocks, so that channels for tones requiring no tone color modification thereof are assigned thereto.

When the tone color is to be changed, an effect to be imparted by a tone color effect-imparting block to which is assigned a channel to be changed in respect of tone color is also changed. If a channel to be changed in respect of tone color is not assigned to any tone color effect-imparting block, i.e. it is assigned to one of the lines Line 3 to Line N, only the tone color is changed.

Although in the first and second embodiments described above, one tone color effect-imparting block is assigned to one channel of a musical tone signal, this is not limitative, but two or more tone color effect-imparting blocks may be assigned thereto. In such a case, if the tone color is to be changed, two or more effects to be imparted by the tone color effect-imparting blocks are also simultaneously changed.

Further, although in the above embodiments, the effecters impart tone color effects and sound field effects, this is not limitative, but if the capacity of the DSP allows provision of further steps, reverberation effects, for example, may be imparted by one or more of the tone color effect-imparting blocks 202 to 205 in the first embodiment, and 302 and/or 303 in the second embodiment, or inversely, tone color effects may be selectively imparted by the sound field effect-imparting blocks 236 in the first embodiment, and 326 in the second embodiment. Further, there may be provided at least one tone color effect-imparting block or at least one sound field effect-imparting block which is constructed such that combinations of effects (e.g. distortion+chorus, chorus+reverberation) are imparted to musical tone signals thereby.

Further, at least one tone color effect-imparting block may be constructed such that two or more effects can be imparted in series or in parallel, to a musical tone signal. However, such a variation can be regarded as a functioning block forming one tone color effect-imparting block as a whole, and hence detailed description thereof is omitted.

Although in the first embodiment, the effecter is constructed such that when the bypass switch BP 1 (*3c*) is turned on, all the tone color effect-imparting blocks 202 to 205 are bypassed, this is not limitative, but there may be provided bypass switches for respective tone color effect-imparting blocks, each permitting a musical tone signal to bypass a corresponding tone color effect-imparting block.

A change of tone color can be directed from an external device by way of MIDI (Musical Instrument Digital Interface). When a change of a tone color for an individual channel is directed from such an external device, a tone color effect corresponding to the channel is changed to suit an updated tone color. Further, when a multiple change, i.e. a change of tone colors for all the channels is directed, the tone colors of all the channels of the TG 4 and all the effects including the sound field effect are changed, as described hereinabove.

As described above, according to the invention, a single effect imparting means for imparting an effect requiring a large size of circuitry, such as a sound field effect, to be imparted to musical tones is provided for common use for all the channels to thereby reduce the circuitry size, whereas a plurality of effect imparting means for imparting effects not requiring such a large circuitry size, such as chorus and distortion, are provided, respectively, for the channels, to thereby enable designing the entire circuitry compact in size while securing a wide variety of freedom in modifying tone colors of musical tone signals as well as in creating a sound field.

Further, according to the invention, at least one of at least two effect imparting means can be bypassed, to thereby enable finely varying parameters to be used by effect imparting means, as well as make it convenient to connect the effect imparting device or the electronic musical instrument to an external effect for creating large-scale sound fields.

Moreover, according to the invention, when the tone color of a signal from at least one channel is instructed to be changed, it is possible to also change an effect corresponding to the tone color, without changing the sound field effect, to thereby enable preventing the change of the tone color from affecting other tone colors of a musical tone being then generated or causing a feeling of unnaturalness, in changing the tone color per channel during automatic performance or a like performance operation.

Still further, according to the invention, it is possible to send to an external device such as a mixer, a sound recorder, and an effecter musical tones of a plurality of channels to which respective different effects have been imparted, in a manner independent of or separate from each other. As a result, an external device such as a mixer and an effecter, which is connected to the present effect imparting device, can process musical tones of a plurality of channels with respective different effects imparted thereto from the present device, as completely independent musical tones (musical instrument tones). This makes it unnecessary to connect an external effecter for modifying tone colors directly to the present device, and enables connecting a mixer or a like device thereto in PA, sound recording, etc. whereby the levels of the respective output musical tones can be individually adjusted, thus making the present device very convenient to use or operate or afford a wide variety of uses. Besides, deterioration of the tone quality can be avoided when a musical tone signal is processed by a DA converter or an AD converter, which would occur when an external effecter is connected to a conventional effect imparting device.

What is claimed is:

1. An effect imparting device comprising:

a plurality of effect imparting means for imparting effects to musical tone signals;

bypass means for bypassing at least one of said effect imparting means;

bypass directing means for giving a direction for causing said bypass means to bypass said at least one effect imparting means; and bypass control means responsive to said direction from said bypass directing means, for controlling said bypass means to bypass said at least one effect imparting means, wherein said plurality of effect imparting means include a plurality of first effect imparting means for imparting respective different tone color effects to said musical tone signals transmitted via a plurality of channels, and at least one second effect imparting means for imparting at least one sound field effect to said musical tone signals.

2. An effect imparting device as claimed in claim 1, wherein said bypass directing means is capable of directing said bypass means to selectively bypass at least one of said first effect imparting means or said at least one second effect imparting means.

3. An effect imparting device as claimed in claim 1, wherein said bypass means comprises at least one first multiplier connected in parallel with said at least one effect imparting means, and at least one second multiplier connected in series to said least one effect imparting means, said bypass means bypassing said at least one effect imparting means by changing coefficients of said first and second multipliers.

4. An effect imparting device as claimed in claim 1, wherein said bypass means comprises at least one first multiplier connected in parallel with said at least one effect imparting means, and at least one second multiplier connected in series to said at least one effect imparting means, said bypass means bypassing said at least one effect imparting means by changing coefficients of said first and second multipliers.

5. An effect imparting device as claimed in claim 2, wherein said bypass means comprises at least one first multiplier connected in parallel with said at least one effect imparting means, and at least one second multiplier connected in series to said least one effect imparting means, said bypass means bypassing said at least one effect imparting means by changing coefficients of said first and second multipliers.

6. An electronic musical instrument comprising:

first effect imparting means for imparting effects of a first kind which are different from each other, respectively, to a plurality of musical tone signals transmitted via a plurality of channels;

mixing means for mixing at least two of said musical tone signals to which effects have been imparted by said first effect imparting means;

second effect imparting means for imparting at least one effect of a second kind to an output from said mixing means;

tone color changing means for changing a tone color of at least one of said musical tone signals transmitted via at least one of said channels;

effect changing means for changing at least one of said effects of said first kind corresponding to said at least one musical tone signal, in response to a change of said tone color of said at least one musical tone signal by said tone color changing means; and effect change control means for controlling said effect changing means to simultaneously change said tone color of said at least one musical tone signal and said at least one effect of said first kind corresponding to said at least one musical tone signal, while inhibiting changing said at least one effect of said second kind.

7. An electronic musical instrument as claimed in claim 6, wherein said first effect imparting means impart respective different tone color effects as said effects of said first kind to said musical tone signals.

8. An electronic musical instrument as claimed in claim 6, wherein said second effect imparting means imparts at least one sound field effect as said at least one effect of said second kind to said output from said mixing means.

9. An electronic musical instrument as claimed in claim 7, wherein said second effect imparting means imparts at least one sound field effect as said at least one effect of said second kind to said output from said mixing means.

10. An electronic musical instrument comprising:

a plurality of effect imparting means for imparting tone color effects which are different from each other, respectively, to a plurality of musical tone signals transmitted via a plurality of channels; and a plurality of output terminals for outputting said musical tone signals to which said tone color effects have been imparted by said effect imparting means, separately from each other, to an external device.

* * * * *